US007156662B2

(12) United States Patent
Goko

(10) Patent No.: US 7,156,662 B2
(45) Date of Patent: Jan. 2, 2007

(54) LIGHT GUN FOR PISTOL AND RIFLE

(75) Inventor: Junichi Goko, Tokyo (JP)

(73) Assignee: NEC Corporation, Tokyo (JP)

( * ) Notice: Subject to any disclaimer, the term of this patent is extended or adjusted under 35 U.S.C. 154(b) by 606 days.

(21) Appl. No.: 10/455,449

(22) Filed: Jun. 6, 2003

(65) Prior Publication Data

US 2003/0228915 A1 Dec. 11, 2003

(30) Foreign Application Priority Data

Jun. 7, 2002 (JP) ..... 2002-167833

(51) Int. Cl.
*F41G 3/26* (2006.01)

(52) U.S. Cl. ..... 434/21; 436/16; 436/22; 362/111; 463/51

(58) Field of Classification Search ..... 434/11, 434/16, 17, 19–23, 27, 365; 463/2, 5, 37, 463/51, 52; 362/111; 222/79; 42/1.02
See application file for complete search history.

(56) References Cited

U.S. PATENT DOCUMENTS

| | | | | |
|---|---|---|---|---|
| 3,950,876 | A | 4/1976 | Wild et al. | |
| 4,083,560 | A * | 4/1978 | Kikuchi et al. | 463/5 |
| 4,171,811 | A * | 10/1979 | Meyer et al. | 463/52 |
| 4,234,911 | A * | 11/1980 | Faith | 362/111 |
| 4,545,583 | A * | 10/1985 | Pearman et al. | 463/5 |
| 4,662,098 | A | 5/1987 | Timari | |
| 4,750,641 | A * | 6/1988 | Chin-Fu | 222/79 |
| 4,898,391 | A * | 2/1990 | Kelly et al. | 463/5 |
| 5,119,576 | A | 6/1992 | Erning | |
| 5,709,046 | A | 1/1998 | Canaday | |
| 5,735,070 | A * | 4/1998 | Vasquez et al. | 42/1.02 |
| 5,842,300 | A | 12/1998 | Cheshelski et al. | |
| 5,947,738 | A | 9/1999 | Muehle et al. | |
| 6,146,141 | A | 11/2000 | Schumann | |
| 6,251,011 | B1 * | 6/2001 | Yamazaki | 463/2 |
| 6,651,642 | B1 | 11/2003 | Powers | |
| 6,817,728 | B1 * | 11/2004 | Goko | 362/111 |
| 2002/0010021 | A1 * | 1/2002 | McCauley | 463/37 |
| 2003/0228913 | A1 * | 12/2003 | Lampl | 463/51 |

FOREIGN PATENT DOCUMENTS

| | | |
|---|---|---|
| DE | 86 02 603 | 3/1986 |
| DE | 91 06 615 | 7/1991 |
| DE | 200 10 929 U1 | 6/2001 |
| EP | 1 369 660 A2 | 12/2003 |
| FR | 2 337 872 | 8/1977 |
| JP | 348078 | 7/1960 |
| JP | 54-50199 | 4/1979 |
| JP | 61-190926 | 8/1986 |
| WO | WO 98/14745 | 4/1998 |

* cited by examiner

*Primary Examiner*—Joe H. Cheng
(74) *Attorney, Agent, or Firm*—Foley & Lardner LLP

(57) ABSTRACT

A light gun includes a trigger unit; a grip coupled to the trigger apparatus; and a barrel unit coupled with the trigger apparatus. The trigger unit has a trigger and a hammer, and the barrel unit includes a light emitting unit which emits a light bullet in response to generation of an impact by the hammer when a trigger operation is carried out by pulling the trigger.

17 Claims, 13 Drawing Sheets

LIGHT GUN FOR PISTOL AND RIFLE

BACKGROUND OF THE INVENTION

1. Field of the Invention

The present invention relates to a light gun from which a light bullet is shot.

2. Description of the Related Art

A shooting game is one of games of the Olympics, and the shooting game is classified into two kinds of games, i.e., a pistol game and a rifle game. The pistol game is on the extension of shooting training of a policeman and promotes shooting training effectively. An actual bullet is used in the game and the training. The use of the actual bullet is not desirable in the viewpoint of expense and safety, and it is desirable to use a light bullet such as a short-wavelength laser beam shot in place of the actual bullet. When the light bullet is used in place of the actual bullet, it is necessary to change the trigger apparatus of the gun.

FIG. 1 shows an example of a trigger apparatus of a conventional gun using the actual bullet. In FIG. 1, a barrel unit is excluded from the gun. The trigger apparatus is composed of a grip portion 101 and a trigger system fixed portion 102. A trigger operating portion 104 is rotatably attached to a main axis 103 arranged in a bottom portion of the trigger system fixed portion 102. The trigger operating portion 104 is composed of a trigger lever 105 rotatably coupled with the main axis 103, and a trigger blade 106 attached to the trigger lever 105. A trigger driven portion 107 carries out a rotating operation in conjunction with the operation of the trigger operating portion 104. The trigger driven portion 107 is composed of a first driven lever 108, a second driven lever 109 and a third driven lever 110. The first driven lever 108 is formed as a unit together with the trigger lever 105 and rotates around the main axis together with the trigger lever 105. The second driven lever 109 operates in conjunction with the first driven lever 108 but not formed as a unit with the first driven lever 108. The third driven lever 110 operates in conjunction with the first driven lever 108 but not formed as a unit with the second driven lever 109. The second driven lever 109 and the third driven lever 110 are rotatably supported by rotation axes different from each other. When a shooter pulls the trigger blade 106, based on the angular displacement in the neighborhood of the top dead point of each of the second driven lever 109 and the third driven lever 110, the third driven lever 110 rotates by a small angle so that a hammer section 112 stopped or fixed by the third driven lever 110 is released from the stopped position and starts to move in a moment in spring power. Thus, the actual bullet is shot through the explosion of gunpowder due to impact of the hammer 112. In the gun for shooting an actual bullet, the trigger apparatus, a grip 101 and a barrel passing the actual bullet are made as a unit to increase the strength, and the gun can endure the impact of the trigger operation, the explosion of a gunpowder, and the reaction of the bullet shooting.

FIG. 2 shows a conventional pistol-type light gun. The pistol-type light gun is composed of a grip 201 of wood, a barrel unit 202 which is attached to and supported by the grip 201, a trigger 203 arranged in a coupling region between the grip 201 and the barrel 202, a cocking lever 204 as a lever used to return the trigger, a front side gun sight 205 arranged in the front position of the barrel unit, and a back side gun sight 206.

The pistol-type light gun is held by one hand of a shooter in the state that his arm extends into a target direction, the shooter sets his sight on target using cross lines of the gun sights 205 and 206 while restraining the fluctuation of his arm, and then a light bullet is shot toward the target by pulling the trigger 203 with his finger. The trigger 203 gives the reaction of a proper degree to the finger of the shooter in case of the pulling operation. When the reaction in case of the pulling operation is too weak, a relation between the trigger operation and the shooting operation of the light bullet is non-sensitive, and there is a danger that the light bullet is shot carelessly. When the reaction in case of the pulling operation is too strong, the barrel fluctuates in case of the trigger operation. As a result, the light bullet does not hit the target set using the gun sights. The actual bullet gun and the light bullet gun do not have an essential difference in the trigger operation and the reaction operation.

The reaction force corresponding to a dynamic displacement at the moment of the trigger operation acts on the finger, the arm (in case of the pistol) or the shoulder (in case of the rifle) of the shooter. The existence of such reaction becomes the cause of the necessity of the shooting training and is also the cause of the existence of the shooting game.

It is demanded to provide a special trigger apparatus for a light gun since an actual bullet is not shot from the light gun and reaction force is not present in the shooting operation of the light bullet. Also, the simplification of the trigger apparatus is demanded for the shooting game. Moreover, it is desirable that the light gun can be cheaply manufactured.

SUMMARY OF THE INVENTION

Therefore, an object of the present invention is to provide a light gun in which a target of a light bullet and a sight line are positioned by detachable parts.

Another object of the present invention is to provide a light gun which can be used commonly for a pistol and a rifle.

Another object of the present invention is to provide a light gun in which a production cost can be reduced more.

Another object of the present invention is to provide a light gun which can be switched between a pistol or a rifle.

In an aspect of the present invention, a light gun includes a trigger unit; a grip coupled to the trigger apparatus; and a barrel unit coupled with the trigger apparatus. The trigger unit has a trigger and a hammer, and the barrel unit includes a light emitting unit which emits a light bullet in response to generation of an impact by the hammer when a trigger operation is carried out by pulling the trigger.

Here, the barrel unit may further include a light receiving unit which receives a light signal from a target; and an impact sensor which detects the impact and controls the light emitting unit to emit the light bullet.

Also, the light gun may further include a pistol gun sight provided for a front portion of the barrel unit, and may further include a rifle barrel detachably coupled with the barrel unit; and a rifle gun sight provided for a front portion of the rifle barrel.

Also, the trigger unit may include a trigger operating unit which includes the trigger; and a hammer operating unit which includes the hammer and operates in response to the trigger operation. In this case, the trigger operating unit may include a first lever portion provided in the trigger unit to be rotatable around a rotation axis; and a second lever portion as the trigger slidably provided for the first lever portion. The second lever portion is fixed to an optional position of the first lever portion. In this case, the second lever portion may be fixed to the first lever portion in a position closer to the rotation axis when the light gun is used as a pistol, and the second lever portion may be fixed to the first lever portion in a position further from the rotation axis when the light gun is used as a rifle. Also, the second lever portion may extend in a direction diagonal to a direction of the light bullet when the light gun is used as a pistol, and the second lever portion may extend in a direction orthogonal to the direction of the light bullet when the light gun is used as a rifle.

In addition, the second lever portion may include a fixed lever portion fixed to the first lever portion; and an adjustable lever portion rotatably provided for the fixed lever portion. In this case, the light gun may be used as a pistol when the adjustable lever portion is pulled to a side of grip, and the light gun may be used as a rifle when the adjustable lever portion extends straightly from the fixed lever portion.

Also, the grip is detachable, and a first type of grip is used when the light gun is used as a pistol, and a second type of grip is used which is different from the first type of grip, when the light gun is used as a rifle.

In another aspect of the present invention, a light gun includes a trigger unit; a grip detachably provided and coupled to the trigger apparatus; and a barrel unit coupled with the trigger apparatus. The trigger unit has a trigger and a hammer. The barrel unit includes a light receiving unit which receives a light signal from a target to establish a relation of the light gun and the target; a light emitting unit which emits a light bullet in response to generation of an impact by the hammer when a trigger operation is carried out by pulling the trigger; and an impact sensor which detects the impact and controls the light emitting unit to emit the light bullet.

Here, the light gun may further include a pistol gun sight provided for a front portion of the barrel unit.

Also, the light gun may further include a rifle barrel detachably coupled with the barrel unit; and a rifle gun sight provided for a front portion of the rifle barrel.

Also, the trigger unit may include a trigger operating unit which includes the trigger; and a hammer operating unit which includes the hammer and operates in response to the trigger operation. In this case, the trigger operating unit may include a first lever portion provided in the trigger unit to be rotatable around a rotation axis; and a second lever portion as the trigger slidably provided for the first lever portion. The second lever portion is fixed to an optional position of the first lever portion.

In this case, the second lever portion may be fixed to the first lever portion in a position closer to the rotation axis when the light gun is used as a pistol, and the second lever portion may be fixed to the first lever portion in a position further from the rotation axis when the light gun is used as a rifle.

Also, the second lever portion may extend in a direction diagonal to a direction of the light bullet when the light gun is used as a pistol, and the second lever portion may extend in a direction orthogonal to the direction of the light bullet when the light gun is used as a rifle.

Also, the second lever portion may include a fixed lever portion fixed to the first lever portion; and an adjustable lever portion rotatably provided for the fixed lever portion.

Also, the light gun may be used as a pistol when the adjustable lever portion is pulled to a side of grip, and the light gun may be used as a rifle when the adjustable lever portion extends straightly from the fixed lever portion.

Also, it is desirable that the grip is detachable, and a first type of grip may be used when the light gun is used as a pistol, and a second type of grip may be used which is different from the first type of grip, when the light gun is used as a rifle.

DESCRIPTION OF THE PREFERRED EMBODIMENTS

Herein after, a trigger apparatus of a light gun of the present invention will be described with reference to the attached drawings.

Figure 3:
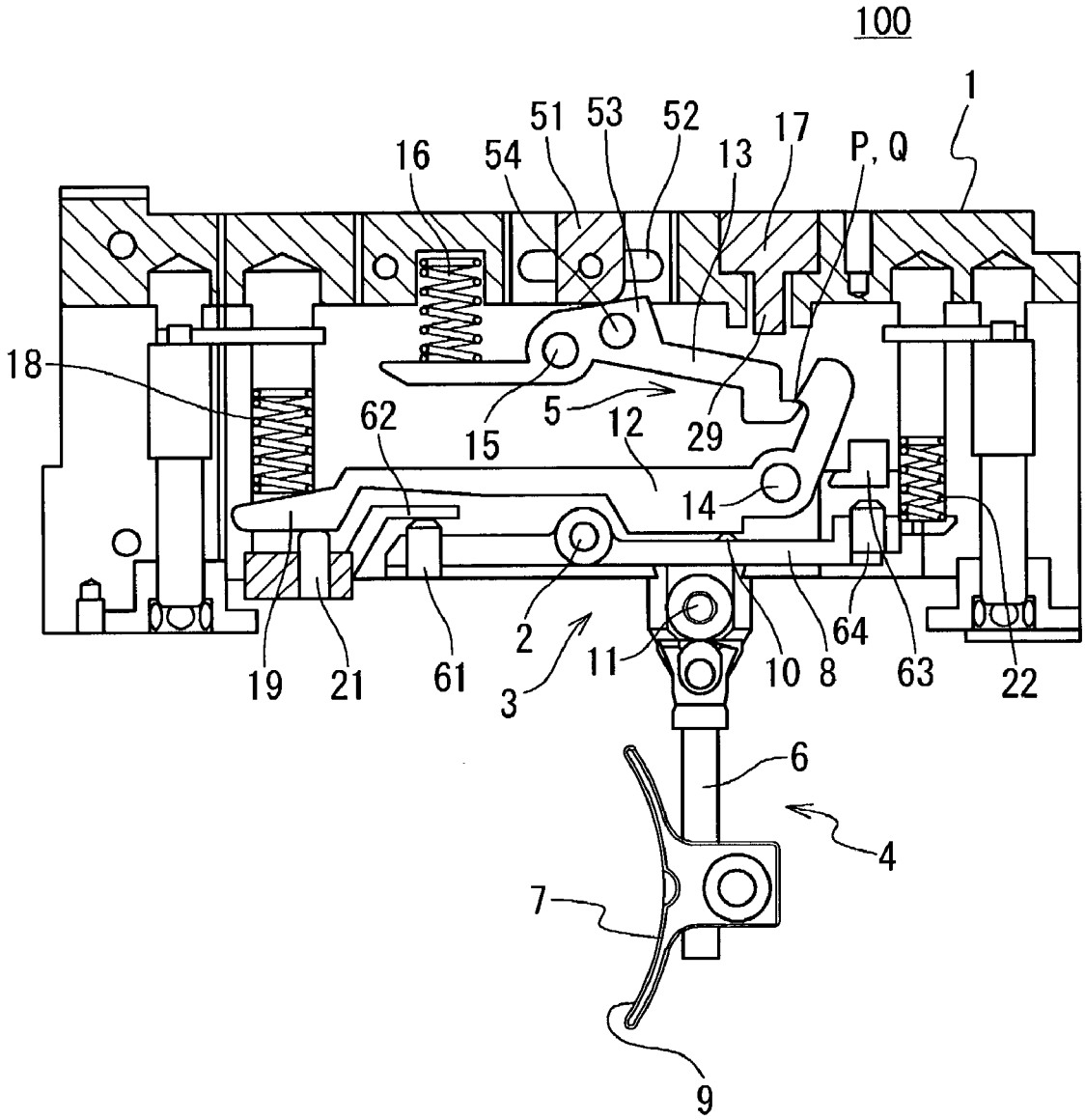
FIG. 3 is a cross sectional view showing a trigger apparatus of a light gun according to an embodiment of the present invention.

FIG. 3 is a side cross sectional view of the trigger apparatus 100 of the light gun according to an embodiment of the present invention. The trigger apparatus 100 is composed of a main body 1, a trigger operation system 3 and a hammer operation system 5 which are arranged in the main body 1 of the trigger apparatus 100 of the light gun.

Figure 4:
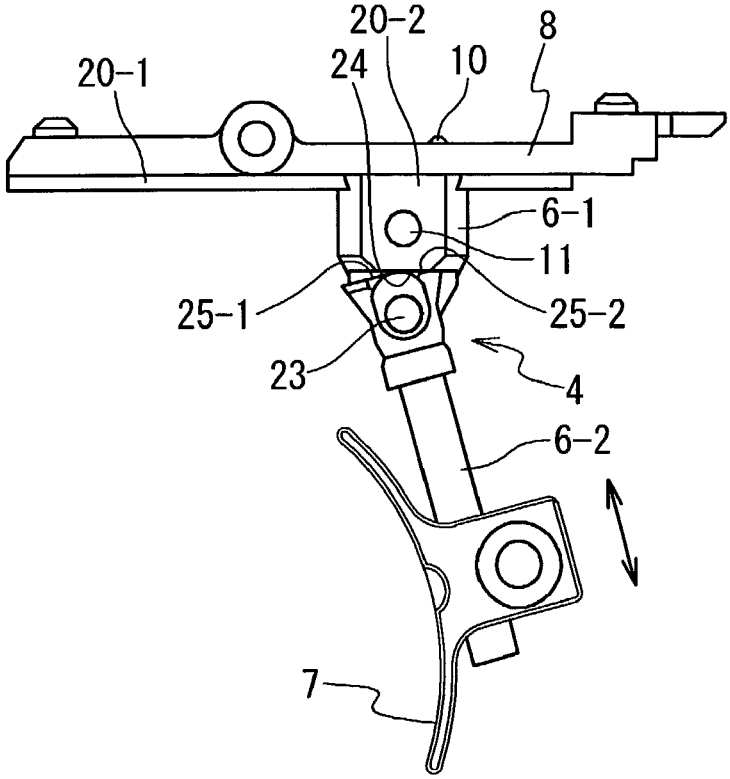
FIG. 4 is a view showing a trigger lever portion for a pistol used in the trigger apparatus according to the embodiment.
Figure 5:
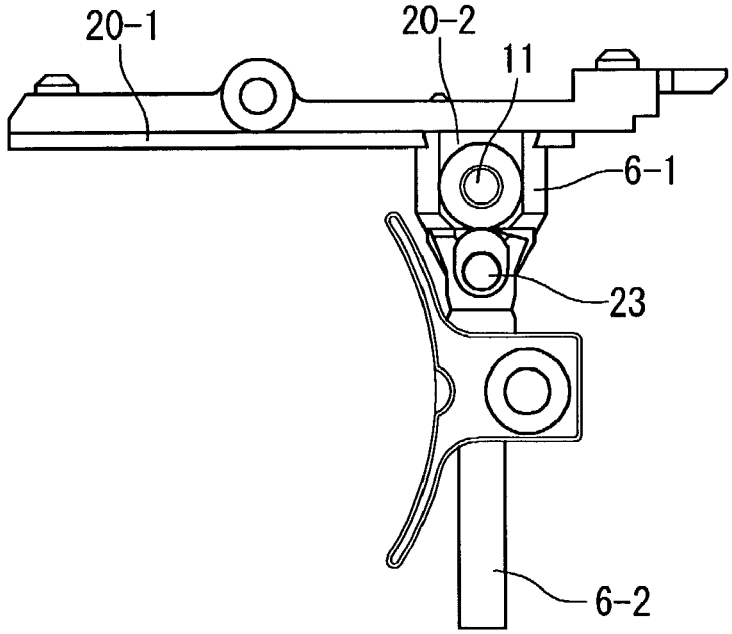
FIG. 5 is a view showing the trigger lever portion for a rifle used in the trigger apparatus according to the embodiment.

The trigger operation system 3 includes a trigger lever portion 4, which includes a first lever portion 6 and a trigger blade 7, and a second lever portion 8. FIGS. 4 and 5 are diagrams showing the trigger lever portion 4. The first lever portion 6 is composed of a fixed lever portion 6-1 and an adjustable lever portion 6-2.

A first rotation axis 2 is fixedly provided for the main body 1 of the trigger apparatus 100. The second lever portion 8 is rotatably supported by the first axis 2. A rail 20-1 is provided for the second lever portion 8, and a ditch 20-2 which fits with the rail 20-1 is formed in the fixed lever portion 6-1. The fixed lever portion 6-1 is slidable and is guided by the rail 20-1. A bolt inserted into an axis 11 contacts the ditch 20-2 with the rail 20-1 to generate friction force and fixes and couples the fixed lever portion 6-1 and the second lever portion 8 as a unit. That is, the fixed lever portion 6-1 can be fixed on an optional position of the rail 20-1 of the second lever portion 8. The light gun in which the fixed lever portion 6-1 is located on the position shown in FIG. 4 is used as a pistol. As shown in FIG. 5, the light gun in which the fixed lever portion 6-1 is situated on the position which is farther from the first axis 2 than the position of the fixed lever portion 6-1 for the pistol is used for a rifle.

A small projection portion 10 is fixedly provided for the second lever portion 8 on the side of the first lever portion 6 with respect to the first rotation axis 2. The first lever portion 6 of the trigger lever portion 4 is provided to be slidable with respect to the second lever portion 8. The first lever portion 6 is fixed to the second lever portion 8 after the first lever portion 6 is set to a desired position. Thus, a rotation radius from the first rotation axis 2 to a coupling point of the first lever portion 6 and the second lever portion 8 is option and variable. The trigger blade 7 is provided for the first lever portion 6 to be slidable. The trigger blade 7 is fixed to the first lever portion 6 after the trigger blade 7 is set to a desired position. The trigger blade 7 has a finger hanging surface 9. In this way, when the trigger blade 7 is pulled by a finger of a shooter, the second lever portion 8 rotates around the first rotation axis 2 in a counterclockwise direction.

The hammer operation system 5 operates in conjunction with the trigger operation system 3. The hammer operation system 5 is composed of a third lever portion 12 and a fourth lever portion 13 operating in conjunction with the third lever portion 12. A second rotation axis 14 and a third rotation axis 15 are fixedly provided for the main body 1 of the trigger apparatus 100. The third lever portion 12 is rotatably supported by the second rotation axis 14, and the fourth lever portion 13 is rotatably supported by the third rotation axis 15.

The second lever portion 8 contacts the third lever portion 12 by the small local projection 10. When the trigger blade 7 is pulled by the finger of the shooter, the third lever portion 12 is pushed by the small local projection 10 and rotates around the second rotation axis 14 in a clockwise direction, since the second lever portion 8 rotates around the first rotation axis 2 in the counterclockwise direction.

An operation end of the third lever portion 12 is P, and an operation end of the fourth lever portion 13 is Q. The operation end P of the third lever portion 12 and the operation end Q of the fourth lever portion 13 engage with each other. The rotation operation of the fourth lever portion 13 is stopped or constrained by the third lever portion 12. When the third lever portion 12 rotates by a small angle in the clockwise direction, the fourth lever portion 13 is released from the engagement with the second lever portion 12 and rotates in the counterclockwise direction in a moment. The fourth lever portion 13 itself or a portion thereof functions as a rotation hammer.

A hammer receiving stopper 17 is provided for the main body 1 of the trigger apparatus 100 on a position opposing to the fourth lever portion 13 rotated in the counterclockwise direction. Before the trigger operation starts, the operation ends P and Q are in the engagement state and exist in the same point or same region. However, when the third lever portion 12 is rotated by a small angle into the clockwise direction, the operation end P moves to an angular position in the clockwise direction and the engagement state with the operation end Q is canceled. As a result, the fourth lever 13 rotates into the counterclockwise direction, and strongly hits the hammer receiving stopper 147.

The force with which rotates the fourth lever portion 13 in the counterclockwise direction is generated by a trigger spring 16 and acts on the other end of the fourth lever portion 13 to rotate the fourth lever portion 13 in the counterclockwise direction. One end portion of the trigger spring 16 is fixed to the main body 1 through a spring force adjustment screw (not illustrated) as a spring force adjustment member. The other end portion of the trigger spring 16 is fixed to the other operation end of the fourth lever portion 13. The magnitude of the force can be adjusted by the spring force adjustment screw provided for a top portion of the trigger spring 16. The magnitude of the force may be changed through the replacement by the trigger spring 16 with different spring force. Through the adjustment of the trigger spring force, the adjustment of speed and strength when the fourth lever portion 13 strikes on the hammer reception stopper 17 can be made possible.

When the finger of the shooter contacting the finger hanging surface 9 of the trigger blade 7 is pulled on the body side of the shooter, the first lever portion 6 rotates in the counterclockwise direction. At this time, the second lever portion 8 rotates in the counterclockwise direction in conjunction with the trigger operation, and the small projection portion 10 pushes the third lever portion 12. Since the small projection portion 10 is provided on the left side from the second rotation axis 14, the third lever 12 is pushed by the small projection portion 10 and rotates in the clockwise direction. Thus, the engagement of the operation end P and the operation end Q is eliminated or canceled, the fourth lever portion 13 is released from the rotation stop force from the third lever portion 12. At this time, the fourth lever portion 13 receives the trigger force equivalent to the spring force of the trigger spring 16 and rotates in the counterclockwise direction. The fourth lever portion 13 strongly hits the lower portion of the hammer receiving stopper 17. In this way, the fourth lever portion 13 functions as a rotary hammer.

A rotation force is always applied to the other operation end of the third lever portion 12 as a rotation bias force for engaging the operation end portion P with the operation end portion Q. In order to apply the rotation bias force to the third lever portion 12, a bias spring 18 is provided for the main body 1. One end of the bias spring 18 is fixed to the main body 1 of the trigger apparatus 100 and the other end of the bias spring 18 is fixed to the other operation end 19 of the third lever portion 12 to push the operation end 19. Thus, the third lever portion 12 is always biased to rotate into the counterclockwise direction by the bias spring 18.

The initial position of the operation end P of the third lever portion 12 before the trigger operation starts is adjusted by an initial position adjustment screw 21. The initial position adjustment screw 21 is arranged at a lower portion of the main body 1 of the trigger apparatus 100.

When the initial position adjustment screw 21 is rotated into a clockwise direction, the initial position adjustment screw 21 moves toward the operation end 19 of the third lever 12 and the third lever portion 12 rotates in the clockwise direction. If the initial position adjustment screw 21 is rotated in the clockwise direction by a predetermined rotation angle, the operation end point P is released from the engagement with the operation end Q of the fourth lever 13 and the operation end Q of the fourth lever portion 13 becomes free.

When the initial position adjustment screw 21 is rotated in the counterclockwise direction, the initial position adjustment screw 21 retreats so that the operation end 19 of the third lever portion 12 rotates in the counterclockwise direction. When the initial position adjustment screw 21 is rotated in the counterclockwise direction by a larger angle, the operation end P moves more toward the operation end Q. The engagement quantity of the third lever portion 12 and the fourth lever portion 13 becomes further larger. By adjusting a rotation quantity of the initial position adjustment screw 21 in the clockwise and counterclockwise directions, the movement quantity of the trigger blade 7 in the trigger operation can be finely adjusted.

It should be noted that a member may be added to change the spring length for the adjustment of the rotation bias force by the bias spring 18. As such a member, a pushing bar may be exemplified which can move linearly in a spring axis direction in conjunction with a handle rotatably supported by the main body 1 of the trigger apparatus 100.

The operation force of the trigger lever portion 4 can be adjusted by an adjustment spring 22 which is arranged in the main body 1 of the trigger apparatus 100 to push a one end portion of the second lever portion 8. The operation force of the adjustment spring 22 influences the trigger operation force. An initial position determining member 62 is fixedly and firmly provided for the main body 1 of the trigger apparatus 100. The initial position determining member 62 may have an elastic property. Also, an initial position adjustment screw 61 is provided rotatably for the main body 1 of the trigger apparatus 100. The clockwise direction rotation of the initial position adjustment screw 61 rotates the one operation end of the second lever portion 8 in the clockwise direction and the counterclockwise direction rotation of the initial position adjustment screw 61 rotates the operation end of the second lever portion 8 in the counterclockwise direction. Such a rotation of the second lever portion 8 determines the operation staring point of the first lever portion 6. Thus, by the operation force of the adjustment spring 22 and by the pushing force of the initial position adjustment screw 61 to the initial position determining member 62, the first lever portion 4 is stabilized on the initial position before the trigger operation starts.

A portion 63 shown in FIG. 3 is a trigger pulling quantity determining terminal which defines a rotation limitation of the second lever portion 8 in the counterclockwise direction. An adjustment screw 64 is provided for the second lever portion 8. A distance between the adjustment screw 64 and the terminal 63 can be adjusted by adjusting the rotation of the adjustment screw 64. The trigger pulling quantity of the first lever portion 6 is defined based on the rotation of a pulling quantity adjustment screw 64 which is forced into the operation end of the second lever portion 8 on the side of the spring 22. It should be noted that the initial position determining member 62 may be rigid plate. Also, it is desirable that the trigger spring 16, the bias spring 18, and the adjustment spring 22 are arranged so that they can be adjusted after installing a barrel unit and/or a grip. Through the arrangement, it is possible to adjust the trigger operation and the trigger reaction while ascertaining the feel of the trigger.

Figure 20:
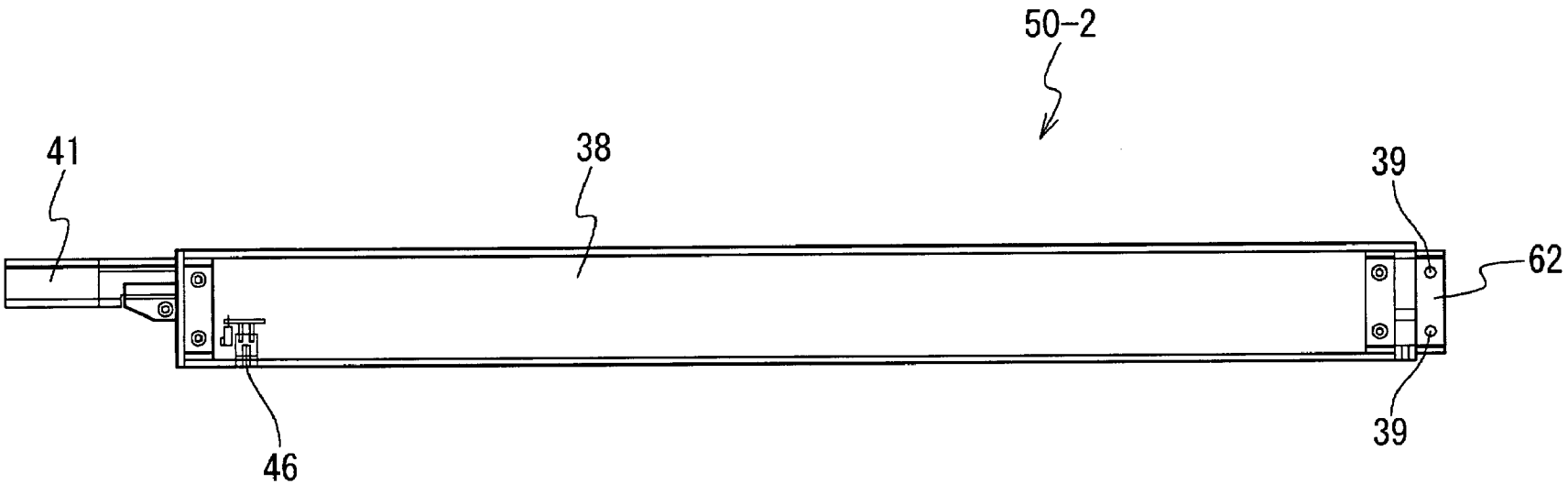
FIG. 20 is a diagram showing the rifle in which a front gun sight for the rifle and the extension barrel for the rifle are coupled to each other.
Figure 21:
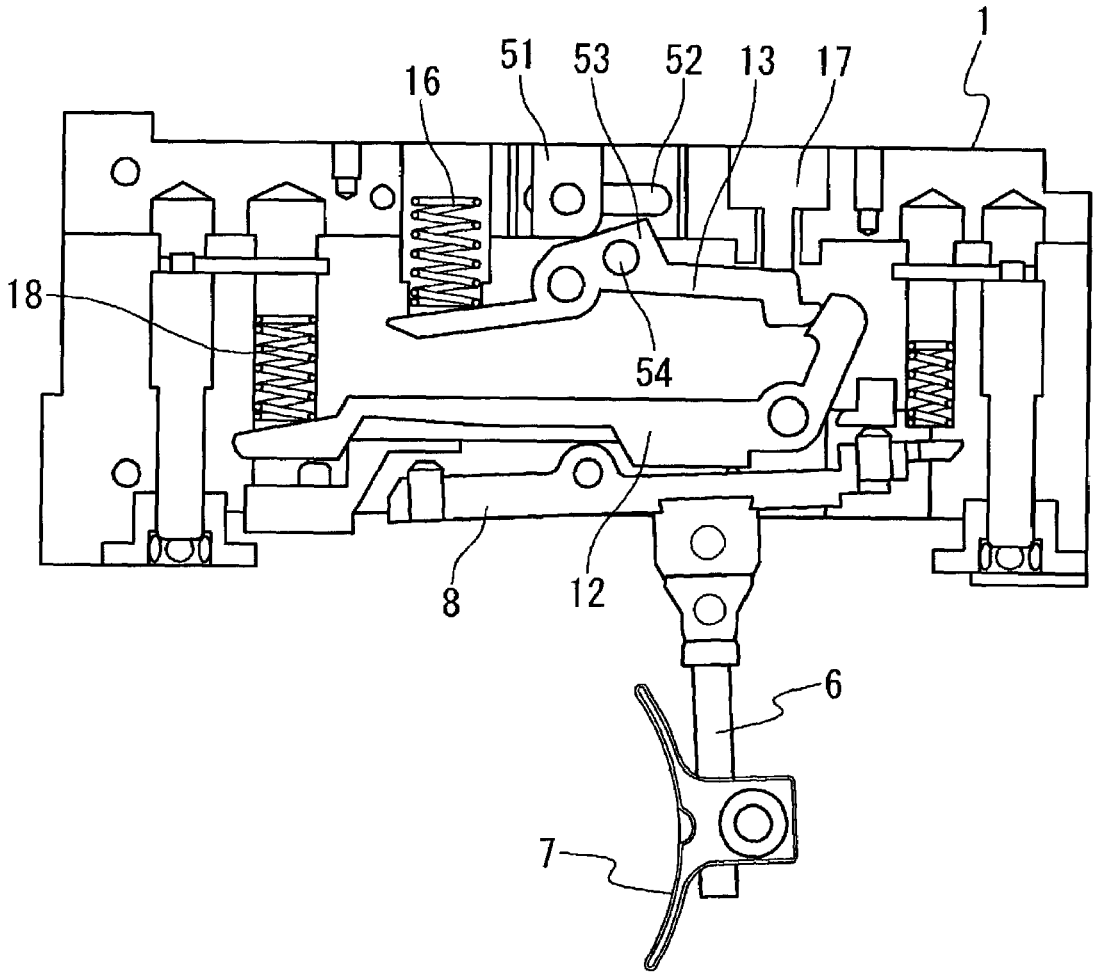
FIG. 21 is a diagram showing an operation of a return unit.

Referring to FIGS. 3 and 20, a return unit 51 is guided in a direction from the front side to the rear side in a guidance ditch 52 provided for the main body 1 of the trigger apparatus 100. The return unit 51 is manually returned to an original position after its operation. As shown in FIG. 20, when the trigger operation is carried out, the fourth lever portion 13 is released from the third lever portion 12 and rotates into the counterclockwise direction. At the same time, the return unit 51 goes ahead into the target. Then, by pulling the return unit 51 to the side close to the shooter, the return unit 51 pushes down a bulge portion 53 of the fourth lever portion 13 to rotate the fourth lever portion 13 in the clockwise direction. The operation end Q of the fourth lever portion 13 rotates in the clockwise direction, contacts the operation end P of the third lever portion 12, and engages with the operation end P again. The return unit 51 may be modified to carry out a rotary operation. In this case, the rotary return unit pushes down the bulge portion 53 of the fourth lever portion 13 in the clockwise direction to rotate it.

Figure 1:
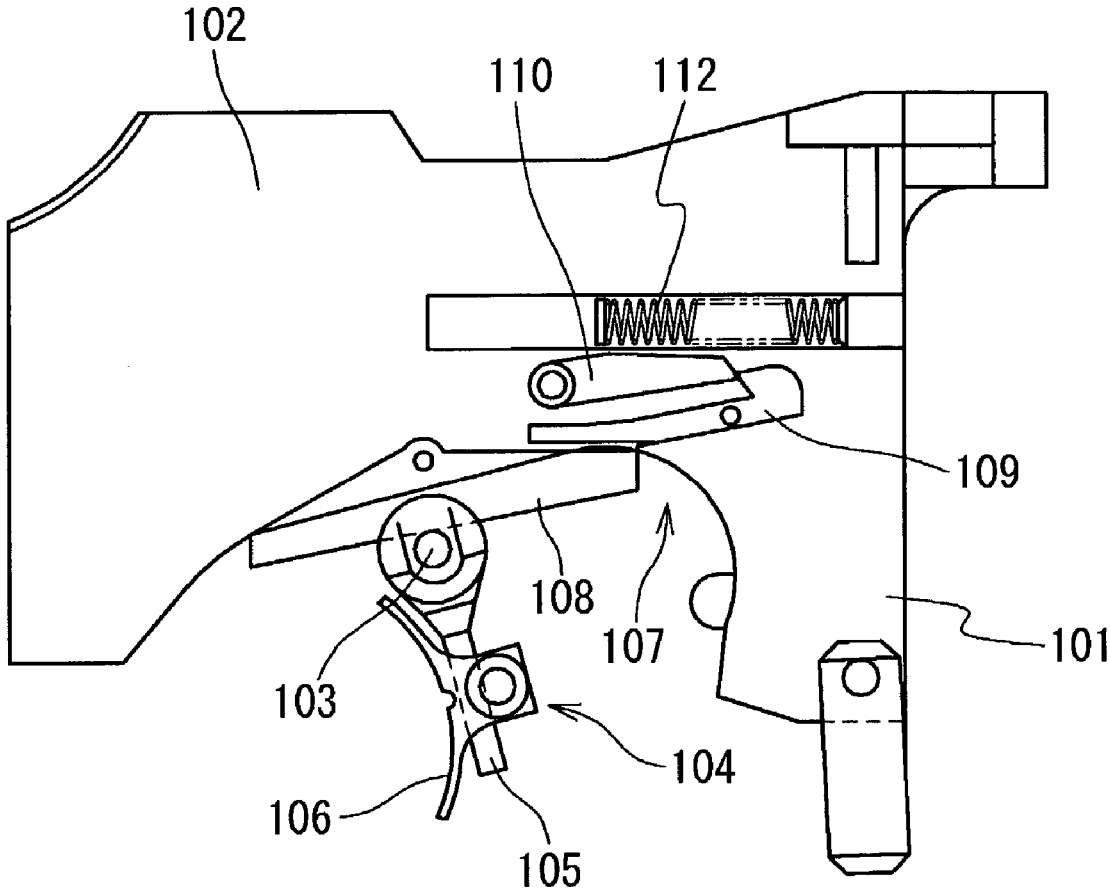
Fig. 1 PRIOR ART
FIG. 1 is a cross sectional view showing a trigger apparatus of a conventional gun for an actual bullet.
Figure 2:
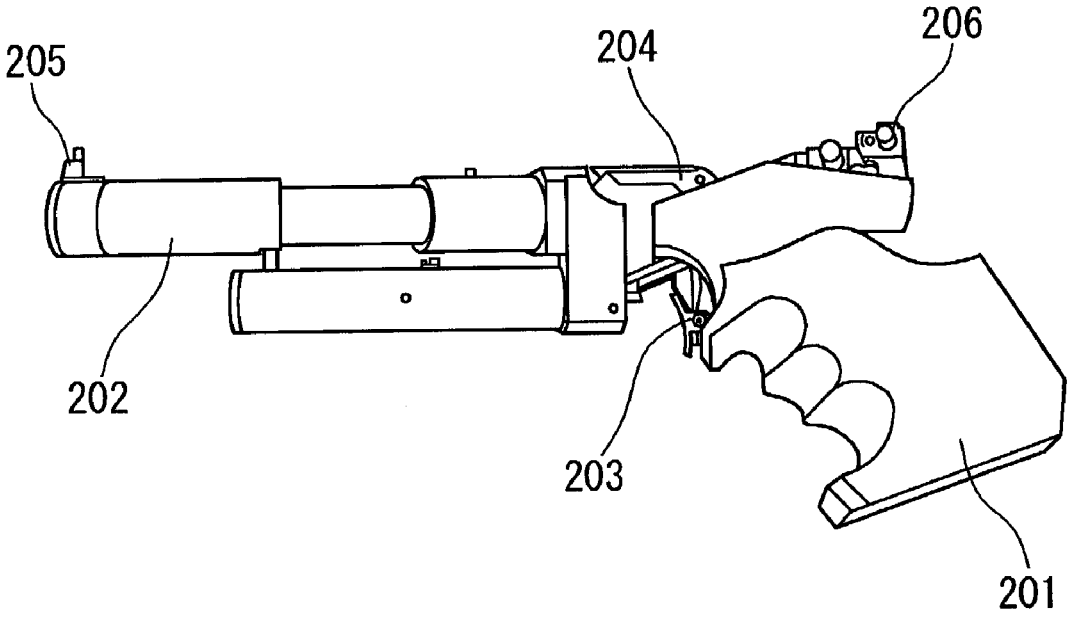
Fig. 2 PRIOR ART
FIG. 2 is a perspective view showing a conventional pistol-type light gun.

By the spring operation to rotate the third lever portion 12 in the clockwise direction and the spring operation to rotate the fourth lever portion 13 in the counterclockwise direction, the third lever portion 12 returns to the original rotation position before the trigger operation, as shown in FIG. 1. Thus, the third lever portion 12 and the fourth lever portion 13 engage with each other.

It is important to provide a hole 54 for the bulge portion 53. It is possible to increase the rotation acceleration of the fourth lever portion 13 by the spring 16 by providing such a hole 54. The time until the hammer portion of the fourth lever portion 13 hits the hammer receiving stopper 17 becomes shorter and the hammer portion hits the stopper 17 at faster speed.

The impact becomes larger based on the acceleration in the short distance. The fourth lever portion 13 can be made light, and the operation of the gun or return unit becomes easy. Also, the impact becomes weak and vibration of the trigger operation is transferred to the barrel unit 31 reliably and an impact sound sensor of the barrel unit 31 senses it to control the shooting operation of the light bullet.

FIG. 4 shows a gun mode switching in the trigger lever portion 4. As described above, the trigger lever portion 4 is slid with respect to the second lever portion 8 and fixed to it by a bolt inserted into a fourth axis 11. The first lever portion 6 is composed of the fixed lever portion 6-1 and the adjustable lever portion 6-2. The adjustable lever portion 6-2 is rotatably coupled with the fixed lever portion 6-1 through a switching axis 23. The first surface 24 of the fixed lever portion 6-1 is formed as a lower surface of the fixed lever portion 6-1 to oppose to the adjustable lever portion 6-2. It is proper that the first surface 24 has a plane or a spherical surface with a little given curvature.

The second surface 25 is formed on the adjustable lever portion 6-2 to oppose to the first surface 24 of the fixed lever portion 6-1. It is proper that the second surface 25 is a composition of a first slope portion 25-1 and a second slope portion 25-2. The first slope portion 25-1 and the second slope portion 25-2 may be formed as the spherical surface coincident with the previously mentioned spherical surface. The first slope portion 25-1 and the second slope portion 25-2 are separated from each other with respect to the switching axis 23 as a center.

By rotating the adjustable lever portion 6-2 in the counterclockwise direction forcefully with respect to the fixed lever portion 6-1, the adjustable lever portion 6-2 can be angularly displaced between a first rotation position on which the first slope portion 25-1 contacts the first surface 24 and a second rotation position where the second slope portion 25-2 contacts the first surface 24. When the adjustable lever portion 6-2 is located on the second rotation position shown in FIG. 4, the light gun is used as a pistol. When the adjustable lever portion 6-2 is located on the second rotation position shown in FIG. 4, the light gun is used as a pistol. When the adjustable lever portion 6-2 is located on the first rotation position shown in FIG. 5, the light gun is used as a rifle. The switching axis 23 is tightened and the adjustable lever portion 6-2 is fixed to the fixed lever portion 6-1. Thus, the first rotation position and the second rotation position can be stably fixed. Such a 2-position switching mechanism is not limited to the forced rotation and is replaced with the bolt tightening after free rotation. As a result, the cost of the parts to be manufactured which are different between the rifle and the pistol, and the number of parts to be carried by the shooter can be reduced, and the convenience is improved.

Figure 6:
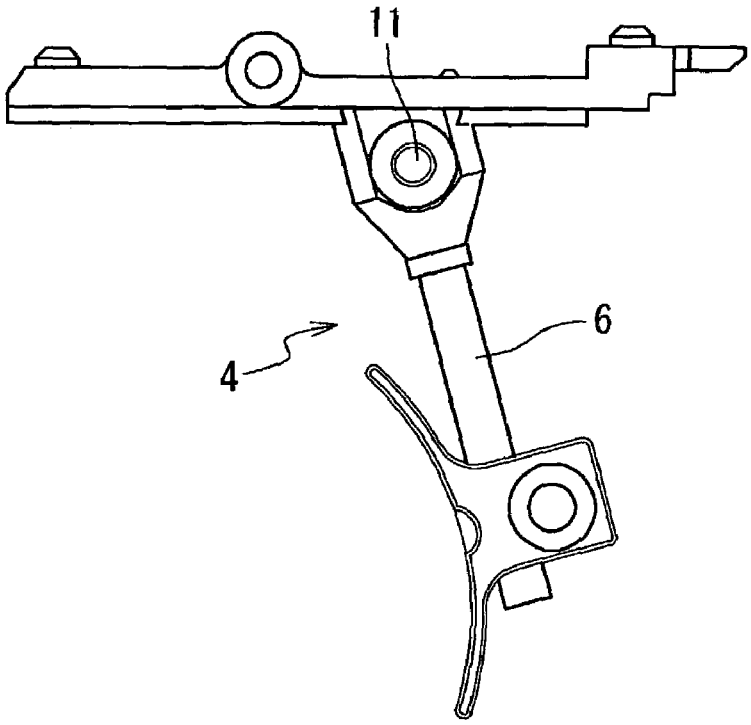
FIG. 6 is a view showing a trigger lever portion for a pistol used in a modification of the trigger apparatus according to the embodiment.
Figure 7:
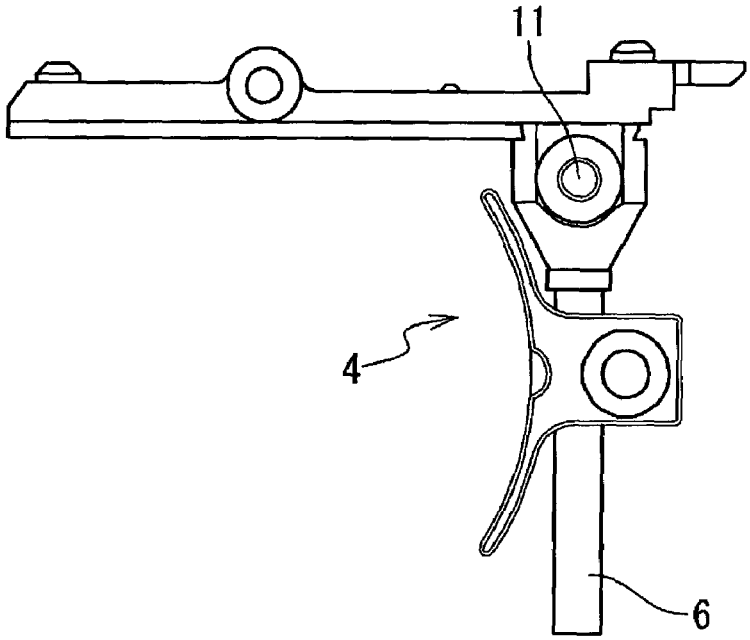
FIG. 7 is a view showing the trigger lever portion for a rifle used in a modification of the trigger apparatus according to the embodiment.

FIG. 6 and FIG. 7 show another gun mode switching in the trigger lever portion 4. The first lever portion 6 shown in FIG. 6 is made to have a shape of a pistol exclusive use type, and the first lever portion 6 shown in FIG. 7 is made to have a shape of a rifle exclusive use type. The first lever portion 6 of the pistol exclusive use type and the first lever portion 6 of the rifle exclusive use type are detachable from the fourth rotation axis 11. The first lever portion 6 of the rifle exclusive use type extends into the direction orthogonal to the center axis of a barrel unit (not shown). The first lever portion 6 of the pistol exclusive use type extends for its bottom portion to come close to the body of the shooter diagonally with respect to the axis of the barrel unit.

Figure 8:
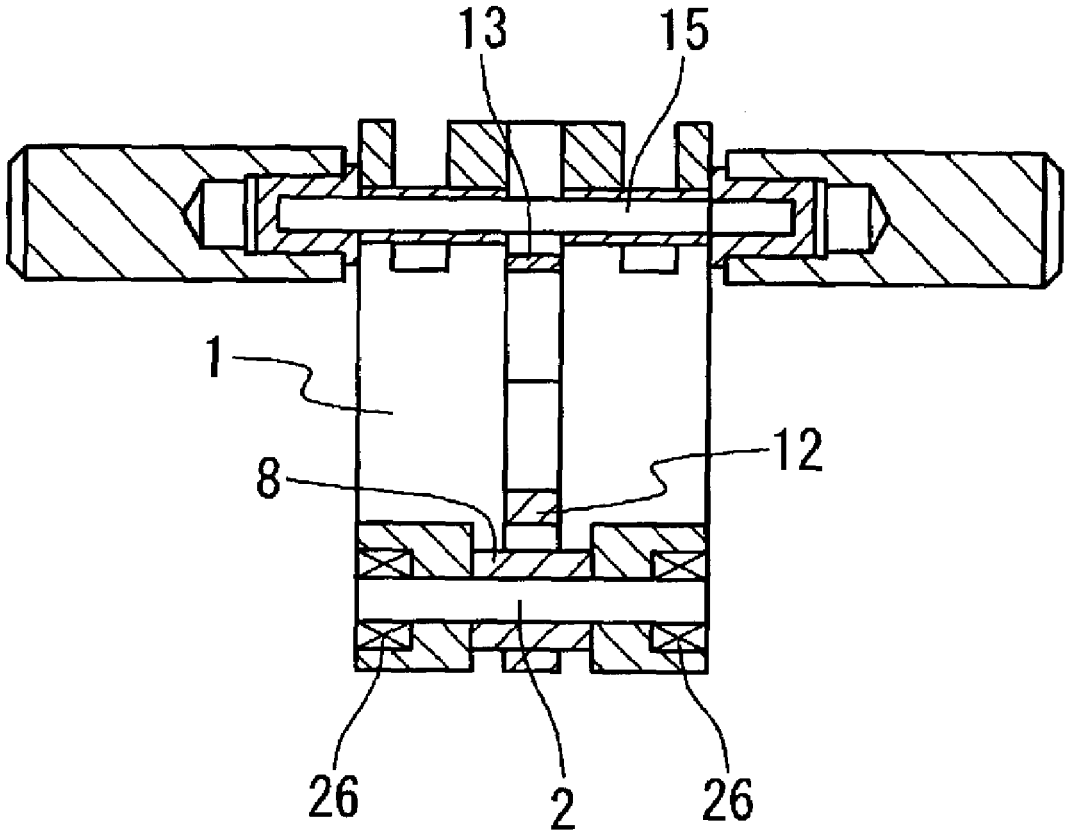
FIG. 8 is a cross sectional view when the trigger apparatus is cut by a plane orthogonal to the center axis of a barrel unit containing a first rotation axis.

FIG. 8 is a cross sectional view when the trigger apparatus 100 is cut by a plane orthogonal to the center axis of the barrel unit containing the first rotation axis 2. The trigger apparatus 100 is shown to have a both side wall forming housing in the cross sectional view of FIG. 8. The third lever portion 12 and the fourth lever portion 13 are attached between two opposing surfaces of the walls of the both side wall forming housing. A circular cylinder portion of the second lever portion 8 supported by the first rotation axis 2 is shown in FIG. 8. The first rotation axis 2 is coaxially inserted into the circular cylinder portion of the second lever portion 8. Two ball bearings 26 are put into each of the walls of the both side wall forming housing and are fixed thereto. The both edge portions of the first rotation axis 2 are rotatably supported by the two ball bearings 26. The second lever portion 8 can be rotated to the trigger apparatus 100 together with the first rotation axis 2.

Figure 9:
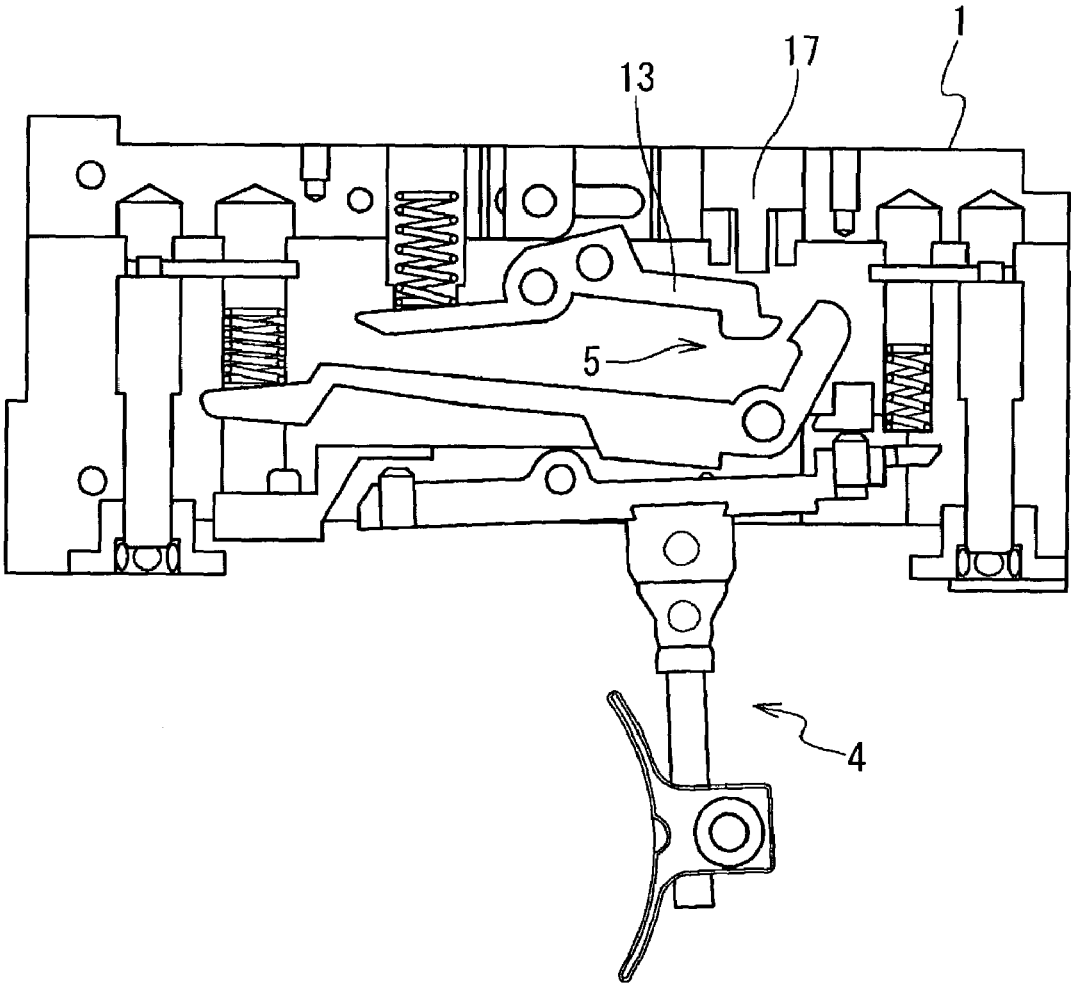
FIG. 9 shows a position relation of a fourth lever portion and a hammer receiving stopper when the fourth lever portion hits the hammer receiving stopper.
Figure 10:
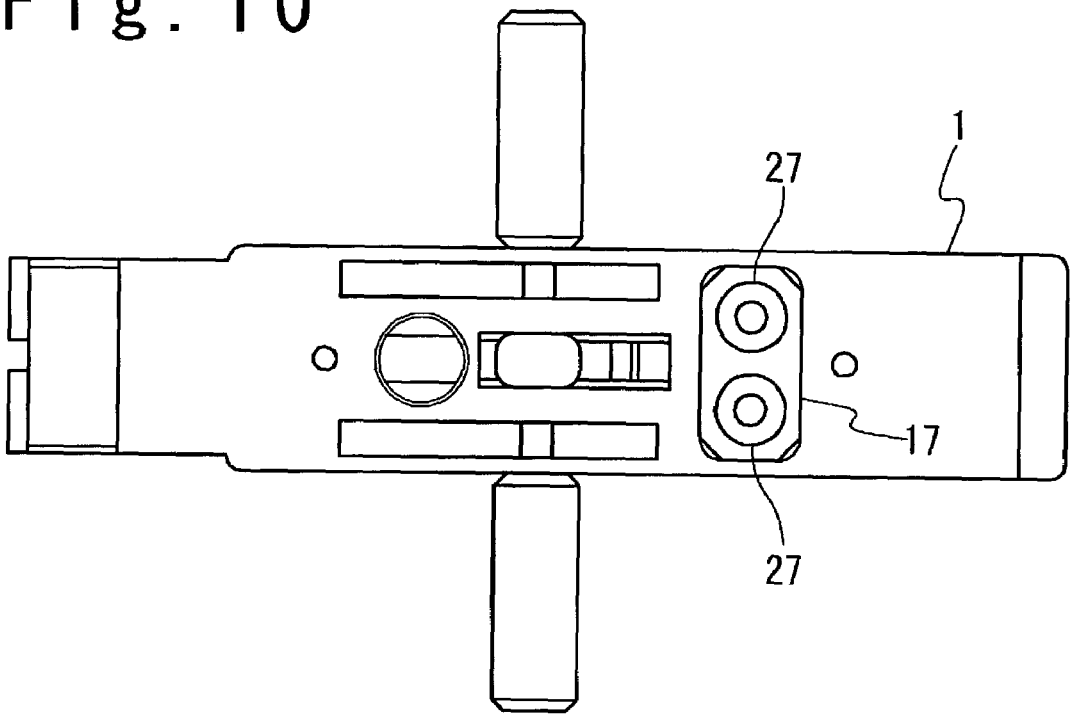
FIG. 10 is a plan view of the trigger apparatus according to the embodiment of the present invention.
Figure 11:
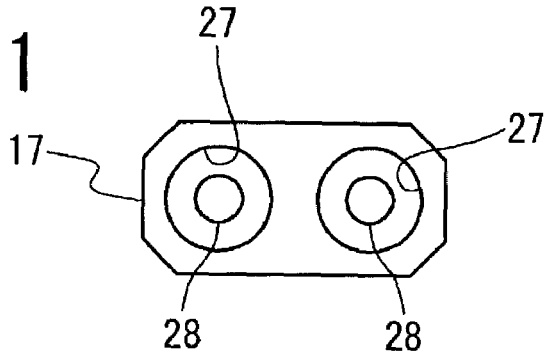
FIG. 11 is a plan view showing a hammer receiving stopper.

FIG. 9 shows a position relation of the fourth lever portion 13 and the hammer receiving stopper 17 when the fourth lever portion 13 hits the hammer receiving stopper 17. The hammer receiving stopper 17 is put into a hole formed on the upper portion of the trigger apparatus 100, as shown in FIG. 10. Two bolt head engagement holes are formed on the upper portion of the hammer receiving stopper 17 for the two bolt head to go into them, as shown in FIG. 11. The screw holes 28 are formed to extend downwardly from the bottoms of the two bolt head engagement holes 27, into the direction of the operation end Q of the fourth lever portion 13. Bolts (not shown) are forced into the two screw holes 28 so that the hammer receiving stopper 17 is firmly fixed to the trigger apparatus 100.

Figure 12:
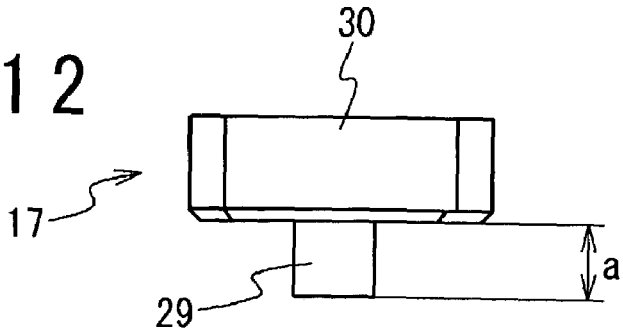
FIG. 12 is a side view showing the hammer receiving stopper.

As shown in FIG. 12, the hammer receiving stopper 17 is composed of a hammer receiving stopper main body portion 29 and a head portion. The lower end surface of the head portion 30 positions the lower end surface of the hammer receiving stopper main body portion 29. The hammer receiving stopper main body portion 29 is located on a center position into the direction orthogonal to the center axis of the barrel unit. The hammer receiving stopper main body portion 29 is formed as a circular column body or a square column body. An upper portion of the fourth lever portion 13 strongly hits the lower end surface of the hammer receiving stopper main body portion 29, when the trigger operation is carried out.

As shown in FIG. 12, the hammer receiving stopper main body portion 29 can be cut to make it possible to adjust the length a. A plurality of types of hammer receiving stoppers 17 may be prepared. By replacing the type of hammer receiving stopper 17 by another one and attaching it to the trigger apparatus 100, an initial distance between the collision surface of the fourth lever portion 13 and a collision surface of the lower end surface of the hammer receiving stopper main body portion 29 before the trigger operation start can be adjusted. By adjusting the length a, the magnitude of the impact in case of the trigger operation can be adjusted.

Figures 13A, 13B:
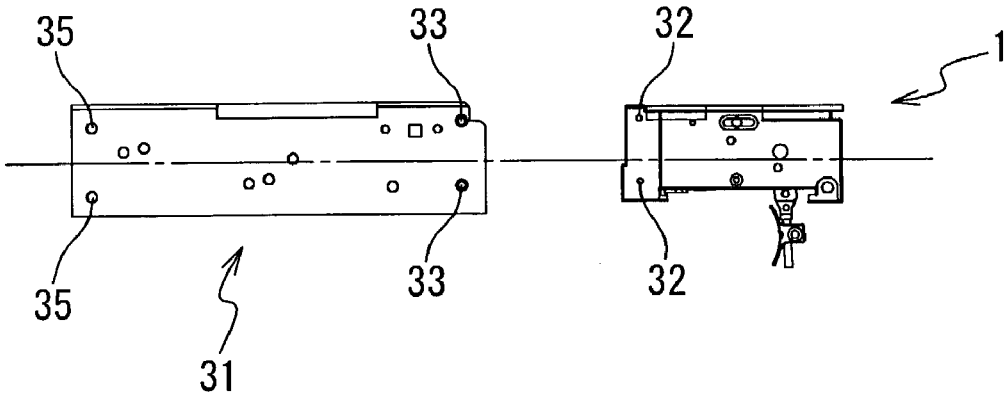
FIGS. 13A and 13B are diagrams showing a barrel unit and the trigger apparatus, respectively.

FIGS. 13A and 13B show a barrel unit 31 and the trigger apparatus 100, respectively. The trigger apparatus 100 functions as a basic unit. The barrel unit 31 is attached to the basic unit 1. A plurality of first coupling holes 32 are arranged in the front region of the basic unit 1. A plurality of second coupling holes 33 are arranged in the rear region of the barrel unit 31. The barrel unit 31 is inserted such that the front portion of the basic unit or main body 1 inserted into the front portion of barrel unit 31 until the first coupling holes 32 and the second coupling holes 33 are coincident with each other in position. One of the first coupling holes 32 and the second coupling hole 33 is screw holes. The screws are passed through the first coupling holes 32 and the second coupling holes 33, are screwed to couple the barrel unit 31 to the basic unit 1.

Figure 14:
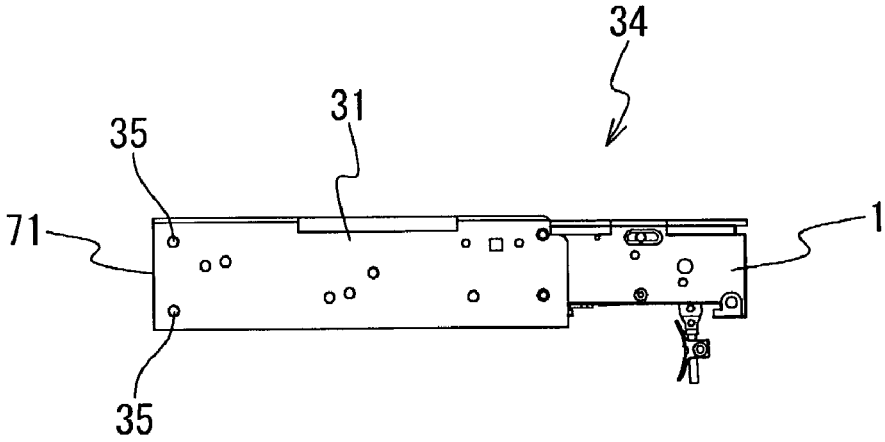
FIG. 14 is a diagram showing a basic main body in which a basic unit and the barrel unit are coupled and assembled.

FIG. 14 shows a basic main body 34 in which the main body 1 and the barrel unit 31 are coupled and assembled. The basic main body 34 is used for a rifle and a pistol. A first attachment plane 71 is provided in the front region of the construction basis main body 34, i.e., the front region of the barrel unit 31, and a plurality of third coupling holes 35 are arranged.

Figure 15:
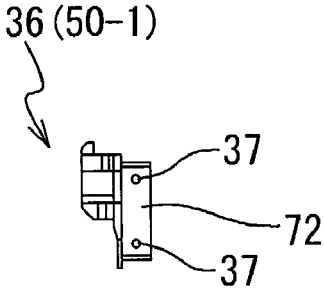
FIG. 15 is a diagram showing a front gun sight for a pistol.

FIG. 15 shows a front gun sight 36 for the pistol. The front gun sight 36 for the pistol is a part for the pistol as a gun sight unit 50-2 for the rifle. A second attachment plane 72 is provided in the rear region of the front sight 36 for the pistol and a plurality of fourth coupling holes 37 are arranged. The rear portion of the front sight 36 for the pistol is inserted in the front portion of the basic main body 34 or the barrel unit 31 until the third coupling holes 35 and the fourth coupling holes 37 are coincident with each other in position. Either of the third coupling holes 35 and the fourth coupling holes 37 are screw holes. The screws are passed through the third coupling hole 35 and the fourth coupling hole 37, and the second attachment plane 72 and the first attachment plane 71 of an construction basis main body 34 are coupled, the front sight 36 for the pistol is coupled to the construction basis main body 34.

Figure 16:
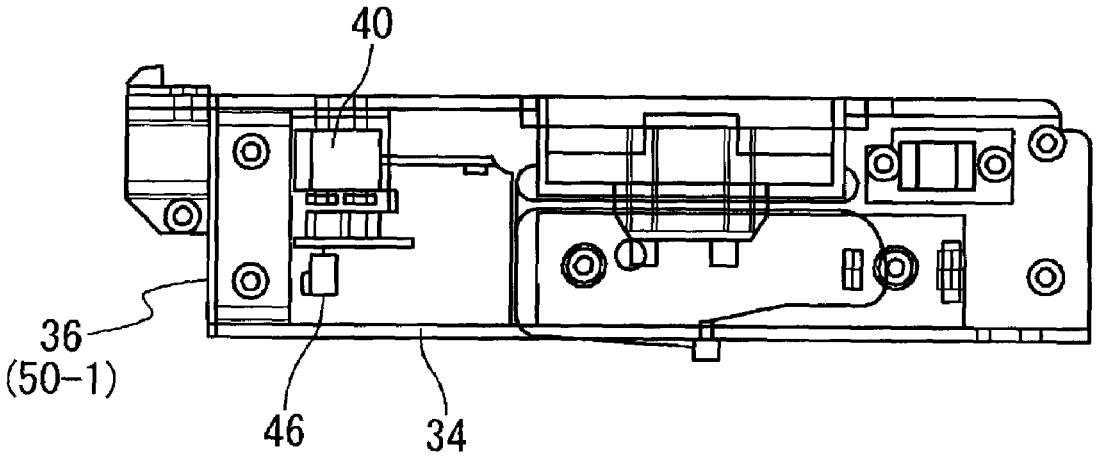
FIG. 16 is a diagram showing the pistol in which the basic main body and a front gun sight for the pistol are coupled and assembled.

FIG. 16 shows the pistol in which the basic main body 34 and the front gun sight 36 for the pistol are coupled and assembled (moreover, a dressed body is added). An infrared light emitting unit 40 is provided for the basic main body 34 to emit a light bullet. The light bullet is an infrared digital signal of infrared ray and the infrared digital signal is used to distinguish the light gun from which the light bullet is shot. Moreover, an infrared ray light receiving unit 46 is provided for a front region of the basic main body 34. The infrared ray light receiving unit 46 receives the infrared digital signal which is radiated from the side of the target. The infrared digital signal is a signal to establish the correspondence of the target and the light gun. Moreover, an impact sound sensor (not shown) is provided for the basic main body 34. The impact sound sensor senses the impact sound when the fourth lever portion 13 strikes on the bottom surface of the hammer receiving stopper body portion 29, and controls the infrared light emitting unit 40 to emit the light bullet.

It should be noted that the infrared light emitting unit 40 may be replaced by a laser for emitting a laser beam shot. Also, the infrared light emitting unit 40 may be replaced by a light emitting unit which shoots a light bullet which moves ahead while spreading, i.e., a light bullet which moves ahead while forming a circular cone with a shooting origin as a convex. In this case, the light gun assembled can imitate a shotgun. Moreover, the infrared light emitting unit 40 can be replaced by a light emitting unit which shoots a plurality of light bullets repeatedly while a trigger is pulled. In this case, the light gun which is assembled at this time can imitate a machine gun. Moreover, it is possible to replace the light bullet of a digital signal by the light bullet of an analog signal.

Figure 17:
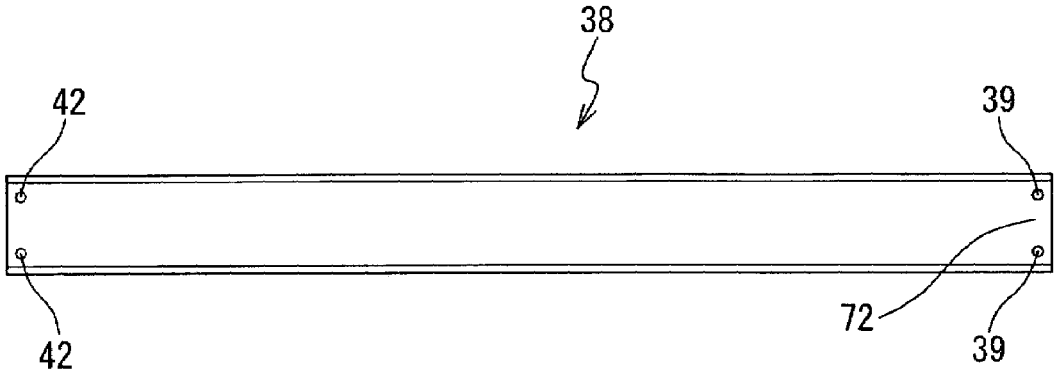
FIG. 17 is a diagram showing an extension barrel for the rifle.

FIG. 17 shows an extension barrel 38 for the rifle. The second attachment plane 72 is provided in the rear region of the extension barrel 38 for the rifle and a plurality of fifth coupling holes 39 are arranged. The rear portion of the extension barrel 38 for the rifle is inserted in the front portion of the basic main body 34 until the third coupling holes 35 of the basic main body 34 and the fifth coupling holes 39 meet with each other in position. Either of the fifth coupling holes 39 and the third coupling holes 35 are screw holes. The screws are passed through the fifth coupling holes 39 and the third coupling holes 35, and the second attachment plane 72 and the first attachment plane 71 of the construction basis main body 34 are coupled to each other and the extension barrel 38 for the rifle is coupled with the basic main body 34.

Figure 18:
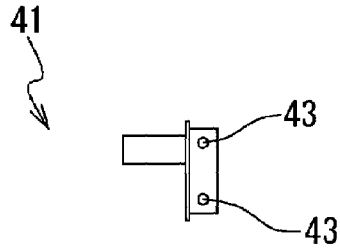
FIG. 18 is a diagram showing a front gun sight for a rifle.
Figure 19:
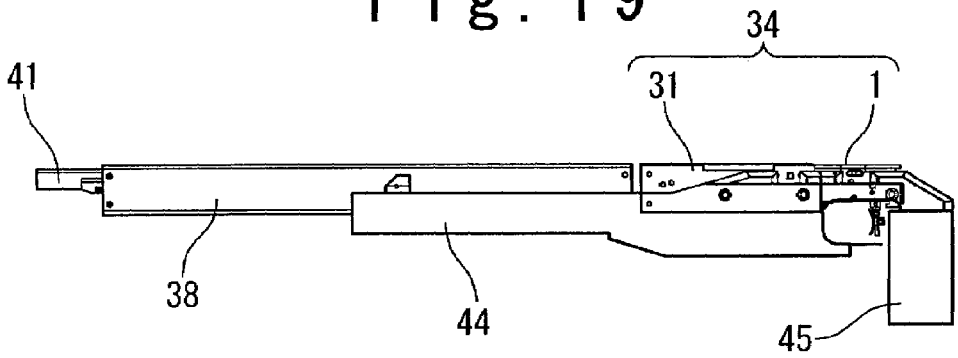
FIG. 19 is a diagram showing the rifle in which a front gun sight for the rifle and the extension barrel for the rifle are coupled with the basic main body.

FIG. 18 shows a front gun sight 41 for the rifle. Sixth coupling holes 42 are arranged in the front region of the extension barrel 38 for the rifle. A plurality of seventh coupling holes 43 are arranged in the rear region of the front gun sight 41 for the rifle. The rear portion of the front sight 41 for the rifle is inserted into the front portion of the extension barrel 38 for the rifle until the sixth coupling holes 42 of the extension barrel 38 and seventh coupling holes 43 meet with each other in position. Either of the seventh coupling holes 43 and the sixth coupling holes 42 are screw holes. The screws are passed through the seventh coupling holes 43 and the sixth coupling holes 42, are screwed and the front gun sight 41 for the rifle is coupled with the extension barrel 38 for the rifle. FIG. 19 shows the rifle in which the front gun sight 41 for the rifle and the extension barrel 38 for the rifle are coupled with the basic main body 34. Moreover, a dressed body 44 and a grip 45 are added.

FIG. 20 shows a rifle barrel unit 50-2 coupled with the front gun sight 41 for the rifle. The infrared light receiving unit 46 is provided in the front region region of the extension barrel 38 for the rifle.

Material of each portion of the light gun is as follows.

Main body 1: Al
First lever portion 6: SUM24L
Trigger blade 7: Al
Second lever portion 8: Al
First reception side lever 12: SKD4
Second reception side lever 13: SKD4
Hammer receiving stopper 17: SKD4

Light weight metal (exemplified as Al) is suitable for the main body of the trigger apparatus 100 to lighten of the gun. It is desirable that the third lever portion 12 and the fourth lever portion 13 which have friction contact with each other are formed of same hard material so that they can move and slide smoothly. For example, SKD4 as alloy tool steel is suitable. It is desirable that the fourth lever portion 13 and the hammer receiving stopper 17 which hit to each other are formed of same hard material, for example, SKD4. SKD4 is excellent in workability and a hardening process and is the optimal in the rigidity after hardening. As the material of the first lever portion 6, SUM24 is suitable because it is excellent in the strength and the workability.

A plurality of springs 16, 18, and 22 can be accommodated in the housing which forms the main body 1 of the trigger apparatus 100. The gun for the actual bullet which is rigidly made has a hole for the lightening. A hole is opened around the hammer and a spring is exposed there. However, the main body 1 of the trigger apparatus 100 of the light gun according to the present invention is light, and stores springs in the housing completely and the human body does not touch any springs and moreover the human body does not touch the hammer.

In the trigger apparatus of the light gun according to the present invention, the hammer is rotated to simplify the structure of the trigger system. Thus, the trigger operation to the shooting can be improved and moreover by deleting the hammer of the gun, the lightening can be realized.

The light gun of the present invention is detachably assembled from a plurality of parts and the target of the light bullet and the gun sights are properly determined. As a result, it is possible for the light gun of the present invention to serve as the pistol or the rifle.

What is claimed is:

1. A light gun comprising:

a trigger unit;

a grip coupled to said trigger unit; and a barrel unit coupled with said trigger unit, wherein said trigger unit has a trigger and a hammer, said barrel unit comprises:

a light emitting unit which emits a light bullet in response to generation of an impact by said hammer when a trigger operation is carried out by pulling said trigger, wherein said trigger unit comprises:

a trigger operating unit which includes said trigger; and a hammer operating unit which includes said hammer and operates in response to said trigger operation, wherein said trigger operating unit comprises:

a first lever portion provided in said trigger unit to be rotatable around a rotation axis; and a second lever portion as said trigger slidably provided for said first lever portion, wherein said second lever portion is fixed to an optional position of said first lever portion, wherein said second lever portion is fixed to said first lever portion in a position closer to said rotation axis when said light gun is used as a pistol, wherein said second lever portion is fixed to said first lever portion in a position further from said rotation axis when said light gun is used as a rifle, and wherein said first lever portion is slidable along rails provided within said trigger unit and is configured to be fixed to a particular position within said trigger unit with respect to a front end and a back end of said trigger unit.

2. The light gun according to claim 1, wherein said barrel unit further comprises:

a light receiving unit which receives a light signal from a target; and an impact sensor which detects said impact and controls said light emitting unit to emit said light bullet.

3. The light gun according to claim 1, further comprising:

a pistol gun sight provided for a front portion of said barrel unit.

4. The light gun according to claim 1, further comprising:

a rifle barrel detachably coupled with said barrel unit; and a rifle gun sight provided for a front portion of said rifle barrel.

5. The light gun according to claim 1, wherein said second lever portion extends in a direction diagonal to a direction of said light bullet when said light gun is used as a pistol, and said second lever portion extends in a direction orthogonal to the direction of said light bullet when said light gun is used as a rifle.

6. The light gun according to claim 1, wherein said light gun is used as a pistol when said adjustable lever portion is pulled to a side of grip, and said light gun is used as a rifle when said adjustable lever portion extends straightly from said fixed lever portion.

7. The light gun according to claim 1, wherein said grip is detachable, and a first type of grip is used when said light gun is used as a pistol, and a second type of grip is used which is different from the first type of grip, when said light gun is used as a rifle.

8. The light gun according to claim 1, further comprising:

a ditch which is configured to fit at a position on the rails of the trigger unit; and a bolt that is configured to be inserted into a position where the fixed lever portion and the adjustable lever portion meet, and wherein the bolt contacts the ditch to generate a friction force so as to couple the fixed lever portion and the second lever portion as a unit.

9. A light gun comprising:

a trigger unit:

a grip coupled to said trigger unit; and a barrel unit coupled with said trigger unit, wherein said trigger unit has a trigger and a hammer, said barrel unit comprises:

a light emitting unit which emits a light bullet in response to generation of an impact by said hammer when a trigger operation is carried out by pulling said trigger, wherein said trigger unit comprises:

a trigger operating unit which includes said trigger; and a hammer operating unit which includes said hammer and operates in response to said trigger operation, wherein said trigger operating unit comprises:

a first lever portion provided in said trigger unit to be rotatable around a rotation axis; and a second lever portion as said trigger slidably provided for said first lever portion, wherein said second lever portion is fixed to an optional position of said first lever portion, wherein said second lever portion comprises:

a fixed lever portion fixed to said first lever portion;

an adjustable lever portion rotatably provided for said fixed lever portion; and a trigger blade that is slidable along a length of said adjustable lever portion and that is capable of being fixed at a particular position along the length of said adjustable lever portion.

10. A light gun comprising:

a trigger unit;

a grip detachably provided and coupled to said trigger unit; and a barrel unit coupled with said trigger apparatus, wherein said trigger unit has a trigger and a hammer, said barrel unit comprises:

a light receiving unit which receives a light signal from a target to establish a relation of said light gun and said target;

a light emitting unit which emits a light bullet in response to generation of an impact by said hammer when a trigger operation is carried out by pulling said trigger; and an impact sensor which detects said impact and controls said light emitting unit to emit said light bullet, wherein said trigger unit comprises:

a trigger operating unit which includes said trigger; and a hammer operating unit which includes said hammer and operates in response to said trigger operation, wherein said trigger operating unit comprises:

a first lever portion provided in said trigger unit to be rotatable around a rotation axis; and a second lever portion as said trigger slidably provided for said first lever portion, wherein said second lever portion is fixed to an optional position of said first lever portion, wherein said second lever portion is fixed to said first lever portion in a position closer to said rotation axis when said light gun is used as a pistol, wherein said second lever portion is fixed to said first lever portion in a position further from said rotation axis when said light gun is used as a rifle, and wherein said first lever portion is slidable along rails provided within said trigger unit and is configured to be fixed to a particular position within said trigger unit with respect to a front end and a back end of said trigger unit.

11. The light gun according to claim 10, further comprising:

a pistol gun sight provided for a front portion of said barrel unit.

12. The light gun according to claim 10, further comprising:

a rifle barrel detachably coupled with said barrel unit; and a rifle gun sight provided for a front portion of said rifle barrel.

13. The light gun according to claim 10, wherein said second lever portion extends in a direction diagonal to a direction of said light bullet when said light gun is used as a pistol, and said second lever portion extends in a direction orthogonal to the direction of said light bullet when said light gun is used as a rifle.

14. The light gun according to claim 10, wherein said second lever portion comprises:

a fixed lever portion fixed to said first lever portion;

an adjustable lever portion rotatably provided for said fixed lever; and a trigger blade that is slidable along a length of said adjustable lever portion and that is capable of being fixed at a particular position along the length of said adjustable lever portion.

15. The light gun according to claim 10, wherein said light gun is used as a pistol when said adjustable lever portion is pulled to a side of grip, and said light gun is used as a rifle when said adjustable lever portion extends straightly from said fixed lever portion.

16. The light gun according to claim 10, wherein said grip is detachable, and a first type of grip is used when said light gun is used as a pistol, and a second type of grip is used which is different from the first type of grip, when said light gun is used as a rifle.

17. The light gun according to claim 10, further comprising:

a ditch which is configured to fit at a position on the rails of the trigger unit; and a bolt that is configured to be inserted into a position where the fixed lever portion and the adjustable lever portion meet, and wherein the bolt contacts the ditch to generate a friction force so as to couple the fixed lever portion and the second lever portion as a unit.

* * * * *